US011278096B2

(12) United States Patent
Dalichau et al.

(10) Patent No.: US 11,278,096 B2
(45) Date of Patent: Mar. 22, 2022

(54) CONTACT LENS CASE

(71) Applicant: BERLISI INDUSTRIES, Springboro, OH (US)

(72) Inventors: Bernard Dalichau, Springboro, OH (US); Gonzalo Perez, Miamisburg, OH (US); Marcelo Perez, New Berlin, WI (US)

(73) Assignee: BERLISI INDUSTRIES, Springboro, OH (US)

( * ) Notice: Subject to any disclaimer, the term of this patent is extended or adjusted under 35 U.S.C. 154(b) by 0 days.

(21) Appl. No.: 17/144,307

(22) Filed: Jan. 8, 2021

(65) Prior Publication Data

US 2021/0127806 A1 May 6, 2021

Related U.S. Application Data

(63) Continuation of application No. PCT/US2019/040832, filed on Jul. 8, 2019.

(60) Provisional application No. 62/695,147, filed on Jul. 8, 2018.

(51) Int. Cl.
*A45C 11/00* (2006.01)

(52) U.S. Cl.
CPC ..... *A45C 11/005* (2013.01)

(58) Field of Classification Search
CPC ..... A45C 11/005
USPC ..... 206/1.5
See application file for complete search history.

(56) References Cited

U.S. PATENT DOCUMENTS

| | | | | |
|---|---|---|---|---|
| 4,905,819 | A | 3/1990 | Clements et al. | |
| 5,127,517 | A * | 7/1992 | Clements | A61L 12/086 206/5.1 |
| 5,161,559 | A | 11/1992 | Yoshihara et al. | |
| 5,195,549 | A | 3/1993 | Adams | |
| 7,331,449 | B2 | 2/2008 | Pinchassi Dar et al. | |
| 9,980,545 | B2 * | 5/2018 | Sheardown | A45C 11/005 |
| 2004/0173474 | A1 * | 9/2004 | Haggin | A61L 12/086 206/5.1 |
| 2004/0251146 | A1 | 12/2004 | Church et al. | |
| 2005/0186128 | A1 | 8/2005 | Pinchassi Dar et al. | |
| 2006/0266661 | A1 * | 11/2006 | Haggin | A45C 11/005 206/5.1 |
| 2009/0120813 | A1 | 5/2009 | Cook | |

(Continued)

FOREIGN PATENT DOCUMENTS

WO 93/20730 A1 10/1993

OTHER PUBLICATIONS

Notification of Transmittal of the International Search Report and the Written Opinion of the International Searching Authority for International PCT Patent Application No. PCT/US2019/040832; European Patent Office; Rijswijk, Netherlands, dated Oct. 8, 2019.

*Primary Examiner* — Jacob K Ackun
(74) *Attorney, Agent, or Firm* — Thomas E. Lees, LLC

(57) ABSTRACT

A contact lens case is disclosed. The contact lens case has a fluid tank that stores fluid (e.g., contact lens solution, water, etc.). The contact lens case also has two lens assemblies (e.g., a first lens assembly and a second lens assembly), wherein each lens assembly has a lens reservoir that stores a contact lens. Further, each lens assembly has a pressure pump that upon actuation, draws fluid from the fluid tank, through a suction line and a one-way valve, to the corresponding lens reservoir.

15 Claims, 18 Drawing Sheets

(56) References Cited

U.S. PATENT DOCUMENTS

| | | | | |
|---|---|---|---|---|
| 2009/0211925 | A1* | 8/2009 | Don | A45C 11/005<br>206/5.1 |
| 2009/0229999 | A1* | 9/2009 | Haggin | A61L 12/086<br>206/5.1 |
| 2010/0252082 | A1 | 10/2010 | Lim | |
| 2014/0034085 | A1* | 2/2014 | Josephson | A45C 11/005<br>134/18 |
| 2017/0006984 | A1* | 1/2017 | Sheardown | A45C 11/005 |
| 2017/0172269 | A1* | 6/2017 | Lin | A45C 11/005 |
| 2021/0153617 | A1* | 5/2021 | Doniga | A45C 15/00 |

* cited by examiner

CONTACT LENS CASE

CROSS REFERENCE TO RELATED APPLICATIONS

This application is a bypass continuation of International Application No. PCT/US2019/040832, filed Jul. 8, 2019, entitled "CONTACT LENS CASE", which claims the benefit of U.S. Provisional Patent Application Ser. No. 62/695,147, filed Jul. 8, 2018, entitled "CONTACT LENS CASE", the disclosures of which are hereby incorporated herein by reference.

BACKGROUND

Various aspects of the present invention relate generally to contact lens cases, and more specifically to modular contact lens cases.

Millions of people wear contact lenses to compensate for a variety of visual and ocular deficiencies such as presbyopia, hyperopia, and astigmatism. In this regard, many users of contact lenses must periodically remove their contact lenses from their eyes, which requires that the removed contact lenses are temporarily placed in a contact lens case that houses a solution, e.g., for disinfection purposes.

BRIEF SUMMARY

According to aspects of the present disclosure, a contact lens case is disclosed. The contact lens case includes a fluid tank, a first lens assembly that couples to the fluid tank and a second lens assembly, that also couples to the fluid tank. The first lens assembly has a first lens reservoir, and a first pressure pump disposed on a top surface of the lens reservoir. In addition, the first lens assembly has a first suction line that draws fluid from the fluid tank to the first lens reservoir, and a first one-way valve that allows fluid to transfer from the fluid tank, through the first suction line, and into the first lens reservoir of the first lens assembly upon actuation of the first pressure pump.

Analogously to the first lens assembly, a second lens assembly includes a second lens reservoir, and a second pressure pump disposed on a top surface of the second lens reservoir. In addition, the second lens assembly includes a second suction line that channels fluid from the fluid tank to the first lens reservoir, and a second one-way valve that allows fluid to transfer from the fluid tank, through the second suction line, and into the second lens reservoir of the second lens assembly upon actuation of the second pressure pump.

According to still further aspects of the present disclosure, a modular contact lens case has a fluid tank, a first lens assembly removably couplable to the fluid tank, and a second lens assembly removably couplable to the fluid tank. For instance, the first lens assembly may threadably attach and detach from the fluid tank. Likewise, the second lens assembly may also threadably attach and detach from the fluid tank. In a manner similar to that described above, the first lens assembly includes a first lens reservoir, and a first pressure pump disposed on a top surface of the lens reservoir. The first lens assembly also includes a first suction line that draws fluid from the fluid tank to the first lens reservoir, and a first one-way valve that allows fluid to transfer from the fluid tank, through the first suction line, and into the first lens reservoir of the first lens assembly upon actuation of the first pressure pump.

Analogously, the second lens assembly also has a second lens reservoir, and a second pressure pump disposed on a top surface of the second lens reservoir. The second lens assembly further includes a second suction line that channels fluid from the fluid tank to the first lens reservoir, and a second one-way valve that allows fluid to transfer from the fluid tank, through the second suction line, and into the second lens reservoir of the second lens assembly upon actuation of the second pressure pump.

DETAILED DESCRIPTION

Various aspects of the present disclosure are generally directed toward improving contact lens cases, particularly for home use and/or travel use. Typically, a contact lens user that is traveling keeps a contact lens case and a separate container of contact lens solution on hand for storage and disinfection of the contact lenses when the contact lenses are not in use. The frequency of use with respect to the contact case can vary based on what kind of contact lenses the user has (e.g., daily lenses, weekly lenses, etc.). The loss of either of the contact lens case or the solution can be a major inconvenience to the contact lens user.

Accordingly, aspects of the present disclosure relate to a contact lens case that keeps the contact lens case and corresponding contact solution together. Further, aspects of the present disclosure may allow for the contact lens case to be modular, or allow for replacement of components, thus potentially extending the overall lifetime of the contact lens case. By pairing the contact lens case and solution the user does not have to resort to using water or other non-intended solution to substitute for the contact lens solution when no solution is available to store contacts in a corresponding contact lens case.

Aspects of the present disclosure provides a contact lens case the provides the more hygienic manner of caring for contacts either at home or while traveling. Users can get eye infections from improper use, and a percentage of persons who use contacts likely do not have the proper method of caring for them. As such, a contact lens case as set out herein, may be utilized to decrease a likelihood of an infection to the eye.

Contact Lens Case

Figure 1A:
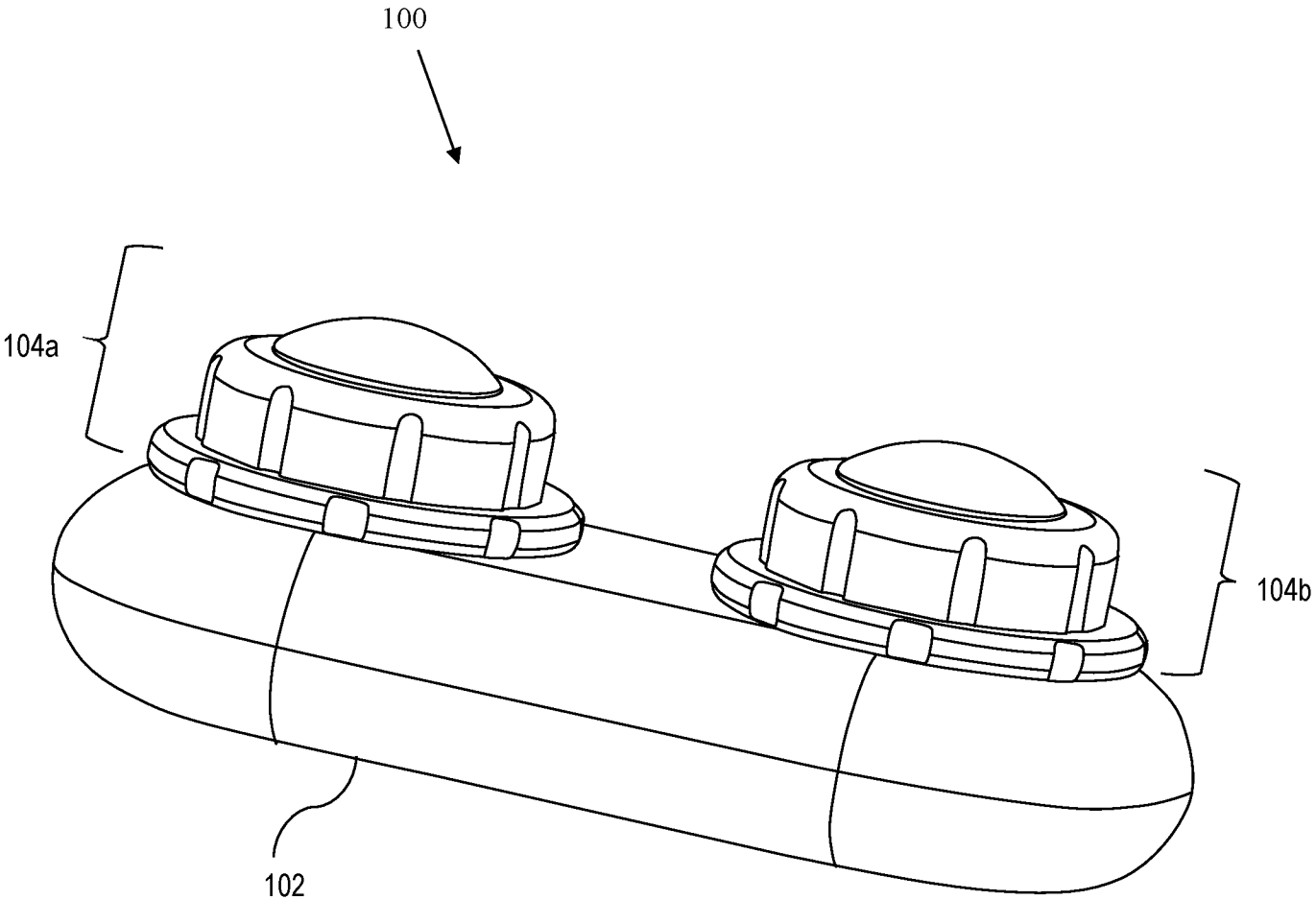
FIG. 1A is perspective view of an example embodiment of a contact lens case according to various aspects of the present disclosure.

Referring now to the drawings, and in particular, to FIG. 1A, an example contact lens case 100 is illustrated, according to aspects of the present disclosure. The contact lens case 100 comprises, a fluid tank 102, a first lens assembly 104*a* coupled to the fluid tank 102, and a second lens assembly 104*b*, which is also coupled to the fluid tank 102. The fluid tank 102 is used to store a fluid, (e.g., a contact lens solution, water, etc.). The first lens assembly 104*a* is used to temporarily store a first contact lens (not shown). Likewise, the second lens assembly 104*b* is used to temporarily store a second contact lens (not shown). In this regard, both soft contact lenses and hard contact lenses may be accommodated.

Upon manual activation, which is described in greater detail herein, the fluid tank 102 supplies proper amounts of the fluid stored therein, to the first lens assembly 104*a*, the second lens assembly 104*b*, or both.

In various embodiments, the first lens assembly 104*a* and the second lens assembly 104*b* are removable from the fluid tank 102. In other embodiments, the first lens assembly 104*a* and the second lens assembly 104*b* are fixedly coupled to the fluid tank 102, integrally manufactured therewith, or are otherwise not intended to be user-removable from the fluid tank 102.

One advantage of removable lens assemblies (e.g., 104*a* and 104*b*) is that having the ability to remove the lens assemblies 104*a* and 104*b* from the fluid tank 102 allows a user to swap out components that break or malfunction.

For example, if a contact lens case is in a backpack, and the backpack gets crushed and damages one of more components of the lens assemblies, then the user can simply swap out the damaged component without having to replace the entire lens case.

Removable and swappable components also allow the user to personalize their respective contact lens case. For instance, the user could replace a stock pressure pump for a pressure pump that has a sports team logo. Alternatively, the user may swap out components to accommodate a specific environment. For instance, if the user is planning to visit a particularly harsh environment, then the user may swap out a stock fluid tank for a ruggedized fluid tank that is more durable.

Moreover, in certain embodiments, the fluid tank 102 is intended to be re-fillable, e.g., to provide repeated use of the contact lens case 100. In other embodiments, the contact lens case 100 can be designed for a limited number of uses, e.g., by preventing a user from refilling fluid tank 102 once the fluid therein has been used.

FIB. 1B illustrates a top view of the contact lens case 100 of FIG. 1A for clarity of discussion, a cross-sectional line A-A that bisects the contact lens case 100 along a length of the fluid tank 102.

Figure 1B:
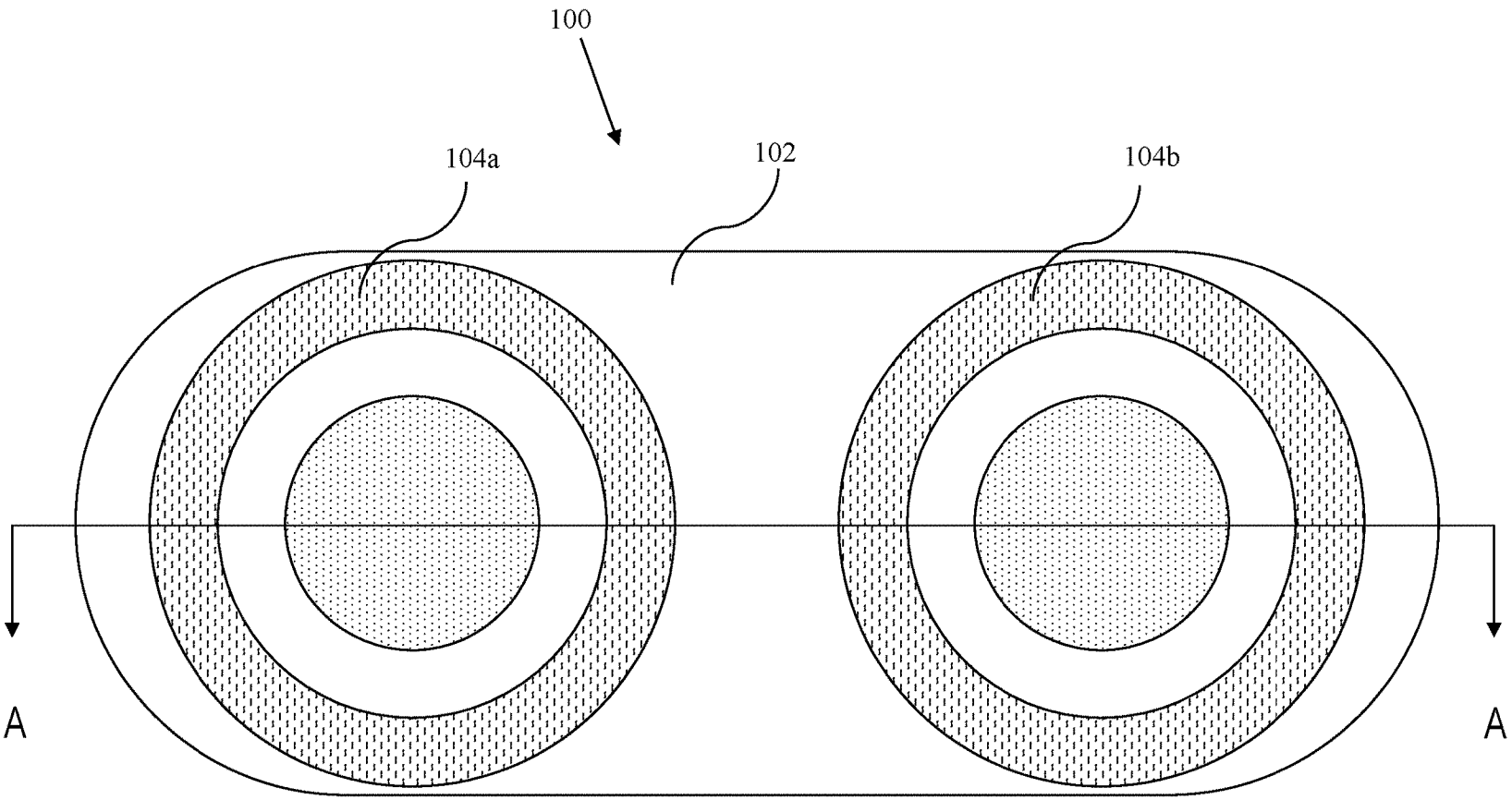
FIG. 1B is a top view of the contact lens case of FIG. 1A.
Figure 1C:
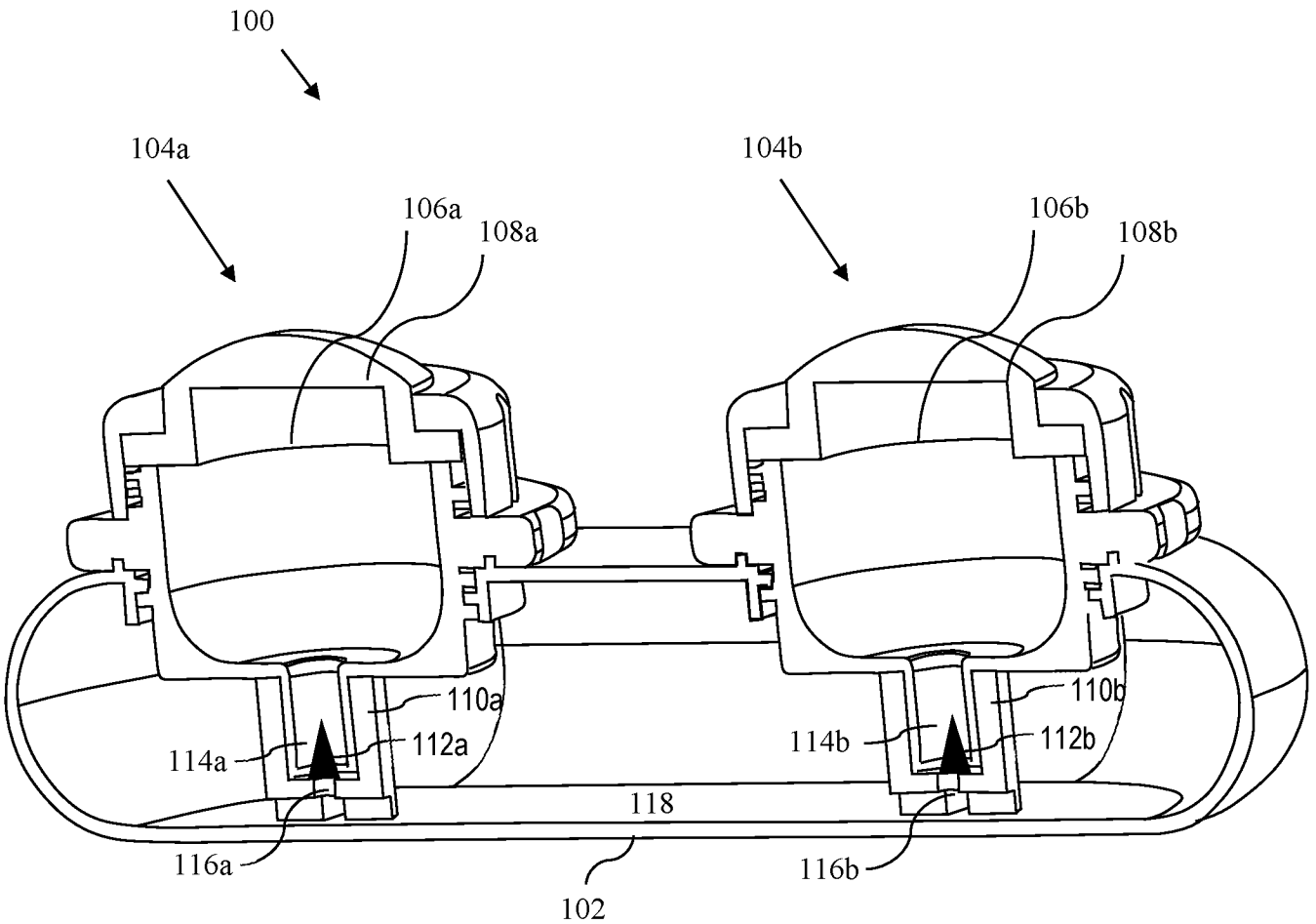
FIG. 1C is a vertical cross-sectional view of the contact lens case of FIG. 1A and FIG. 1B, which is taken along line A-A in FIG. 1B, according to various aspects of the present disclosure.

FIG. 1C illustrates a vertical cross-sectional view of the contact lens case 100 of FIG. 1A, taken along line A-A of FIG. 1B. As illustrated, the fluid tank 102 defines a reservoir that can be used to store a common fluid that can be dispensed to the first lens assembly 104*a*, the second lens assembly 104*b*, or both. While no specific material is required for the fluid tank 102, it may be preferable to utilize a rigid material such as a polymer (e.g., resins, plastics, organic materials, etc.), ceramics, rubber, or metal. Rigid materials may allow for a more consistent structural integrity of the fluid tank 102 during travel (e.g., change in altitude in a plane).

In the illustrative embodiment, the first lens assembly 104*a* comprises a first lens reservoir 106*a*, and a first pressure pump 108*a* that is disposed on a top surface of the lens reservoir 106*a*. The first lens assembly 104*a* also comprises a first suction line 110*a* that draws fluid from the fluid tank 102 to the first lens reservoir 106*a*, and a first one-way valve 112*a* that allows fluid to transfer from the fluid tank 102, through the first suction line 110*a*, and into the first lens reservoir 106*a* of the first lens assembly 104*a* upon actuation of the first pressure pump 106*a*.

Analogously, the second lens assembly 104*b* comprises a second lens reservoir 106*b*, and a second pressure pump 108*b* that is disposed on a top surface of the lens reservoir 106*b*. The second lens assembly 104*b* also comprises a second suction line 110*b* that draws fluid from the fluid tank 102 to the second lens reservoir 106*b*, and a second one-way valve 112*b* that allows fluid to transfer from the fluid tank 102, through the second suction line 110*b*, and into the second lens reservoir 106*b* of the second lens assembly 104*b* upon actuation of the second pressure pump 108*b*.

Spatial characteristics (e.g., shape, volume, etc.) of the fluid tank 102, the first lens reservoir 106*a*, the second lens reservoir 106*b*, or combinations thereof, can be customized based on need. For instance, in embodiments of the contact case 100 where a user may be traveling for an extended period of time (e.g., 14-30 days), the fluid tank 102 may have a relatively larger volume compared to an embodiment that is intended to only be used for 1-14 days.

In alternative embodiments, the first pressure pump 108*a* can be disposed in other positions and/or orientations, so long as actuation of the first pressure pump 108*a* causes fluid to transfer from the fluid tank 102, through the first suction line 110*a*, and into the first lens reservoir 106*a* of the first lens assembly 104*a*. Likewise, the second pressure pump 108*b* can be disposed in other positions and/or orientations, so long as actuation of the second pressure pump 108*b* causes fluid to transfer from the fluid tank 102, through the second suction line 110*b*, and into the second lens reservoir 106*b* of the second lens assembly 104*b*. In various embodiments, the first pressure pump 108*a* and the second pressure pump 108*b* each comprise a flexible membrane.

As noted above, the first lens assembly 104*a* comprises a first suction line 110*a* that draws in fluid from the fluid tank 102 to the first lens reservoir 106*a* upon actuation of the first pressure pump 108*a*. In the illustrative embodiment, the first one-way valve 112*a* is positioned between the first suction line 110*a* and the first lens reservoir 106*a* and is configured to allow fluid to transfer from the fluid tank 102 into the first lens reservoir 106*a* in only one direction.

Likewise, the second lens assembly 104*b* comprises a second suction line 110*b* that draws in fluid from the fluid tank 102 to the second lens reservoir 106*b* upon actuation of the second pressure pump 108*b*. Accordingly, in the illustrative embodiment, the second one-way valve 112*b* is positioned between the second suction line 110*b* and the second lens reservoir 106*b* and is configured to allow fluid to transfer from the fluid tank 102 into the second lens reservoir 106*b* in only one direction.

In various embodiments, the first lens reservoir 106*a* further comprises a first valve channel 114*a* that is adjacent to the first suction line 110*a*, wherein the first valve channel 114*a* further comprises a first inlet 116*a* that accepts fluid from the fluid tank 102. In such embodiments, the first valve channel 114*a* has a first diameter, and the first inlet has a second diameter, wherein the first diameter is greater than the second diameter. An advantage of such a configuration is that having the first inlet 116*a* as a smaller diameter allows for a greater pressure differential when the first pressure pump 108*a* is actuated.

Analogously, in various embodiments, the second lens reservoir 106*b* further comprises a second valve channel 114*b* that is adjacent to the second suction line 110*b*, wherein the second valve channel 114*b* further comprises a second inlet 116*b* that accepts fluid from the fluid tank 102. In such embodiments, the second valve channel 114*b* has a diameter greater than the diameter of the second inlet.

In further embodiments, the suction line 110*a* extends from the first lens reservoir 106*a* to a bottom surface 118 of the fluid tank 102, which may provide greater stability to the first lens reservoir 106*a* and overall first lens assembly 104*a* by having another point of contact. In this regard, alternative embodiments may permanently affix the first suction line 110*a* to the bottom surface 118 of the fluid tank 102. In such an embodiment, the first lens reservoir 106*a* drops into suction line 110*a* (i.e., seats into the suction line), thus further securing the first lens reservoir 106*a*. Another advantage of this type of configuration is that the first suction line 110*a* may prevent the fluid tank 102 from deforming during significant changes in atmospheric or environmental pressure.

Analogously, the suction line 110*b* can extend from the second lens reservoir 106*b* to the bottom surface 118 of the fluid tank 102. In this regard, alternative embodiments may permanently affix the second suction line 110*b* to the bottom surface 118 of the fluid tank 102. In such an embodiment, the second lens reservoir 106*b* drops into suction line 110*b* (i.e., seats into the suction line), thus further securing the second lens reservoir 106*b*.

One advantage of the embodiment(s) described in FIG. 1C is that each pressure pump (108*a* and 108*b* respectively) is independent of one another. This allows a user of the contact case 100 to independently control the amount of fluid that is extracted from the fluid tank 102 to each reservoir 106*a*, 106*b*.

Figure 1D:
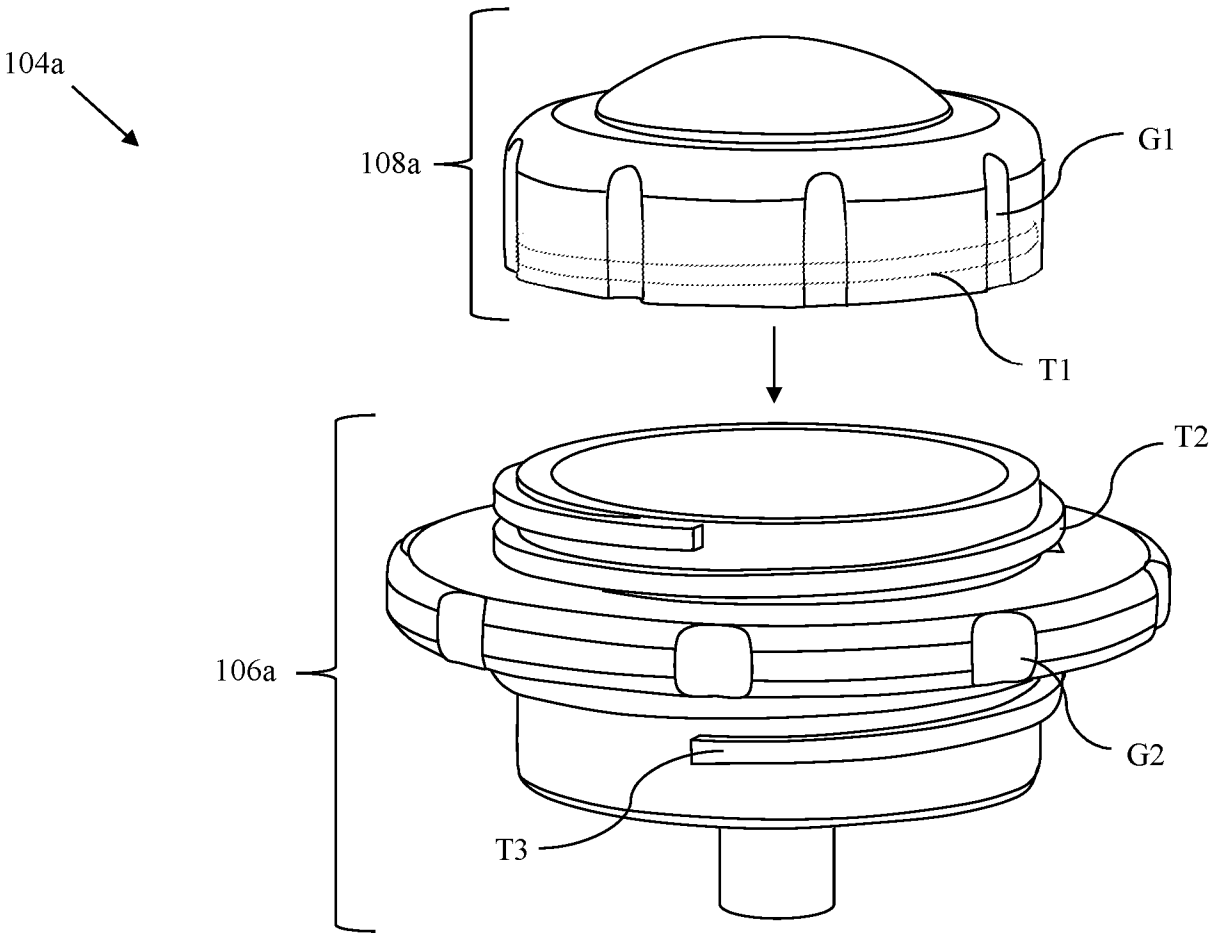
FIG. 1D is a perspective view of a disassembled lens assembly.

As noted herein, in various embodiments the first lens assembly 104*a* and the second lens assembly 104*b* are selectively removable from the fluid tank 102 as illustrated in FIG. 1D.

In FIG. 1D, an example lens assembly 104*a* is disclosed. Here, the pressure pump 108*a* is detached from the first lens reservoir 106*a* and the first lens reservoir 106*a* is detached from the fluid tank (not shown). Also illustrated in FIG. 1D are various threads T1, T2, and T3 that allow various portions of the lens assembly 104*a* to couple to one another in addition to other portions of the contact lens case 100.

For instance, in FIG. 1D, thread T1 on the first pressure pump 108*a* would engage thread T2 of the first lens reservoir. Further, thread T3 would engage threads disposed on the fluid tank (not shown). This configuration is merely by way of example and is in no way limiting in terms of possible coupling configurations. For example, various embodiments may have additional threads, or alternative thread geometries, different methods for fastening, etc.

Moreover, the first pressure pump 108*a* and/or the first lens reservoir may further comprise groove members, G1 and G2 respectively, that allow a user to more easily grip or twist the first pressure pump 108*a* and/or the first lens reservoir as needed. This configuration is merely by way of example and is in no way limiting in terms of possible coupling configurations.

Another advantage is that the contact lens case 100 can be made as a disposable case. The fluid tank 102 may be filled with contact lens solution at construction. In such a configuration, the first lens assembly 104*a* and the second lens assembly 104*b* are permanently fixed to the fluid tank 102 (e.g., the lens assemblies are threaded into the fluid tank with a thread locker). Having a fixed/disposable case may allow for a tighter fit between components, which may reduce the chance of leaks.

Other configurations are also possible. For instance, a contact lens case may comprise only a single lens assembly. In another example embodiment, the fluid tank 102 includes a divider (not shown) such that a first section of the fluid tank 102 services the first lens assembly 104*a* and a second section of the fluid tank 102 services the second lens assembly 104*b*.

Fluid & Air Flow

FIG. 2A-FIG. 2D illustrate multiple mechanisms, arrangements, and configurations that control fluid and air flow within a contact case 200 when a pressure pump is actuated and released, which can be implemented in any number of illustrative ways. The components of contact case 200 are analogous to the components of the contact case 100, except that the reference numbers in FIGS. 2A-2D are 100 higher. Further, all embodiments and disclosures relating to FIGS. 2A-2D can be incorporated with the various processes, definitions, and embodiments disclosed elsewhere herein, and can be combined in any combination of components described with reference thereto. In this regard, not every disclosed component need be incorporated.

Figure 2A:
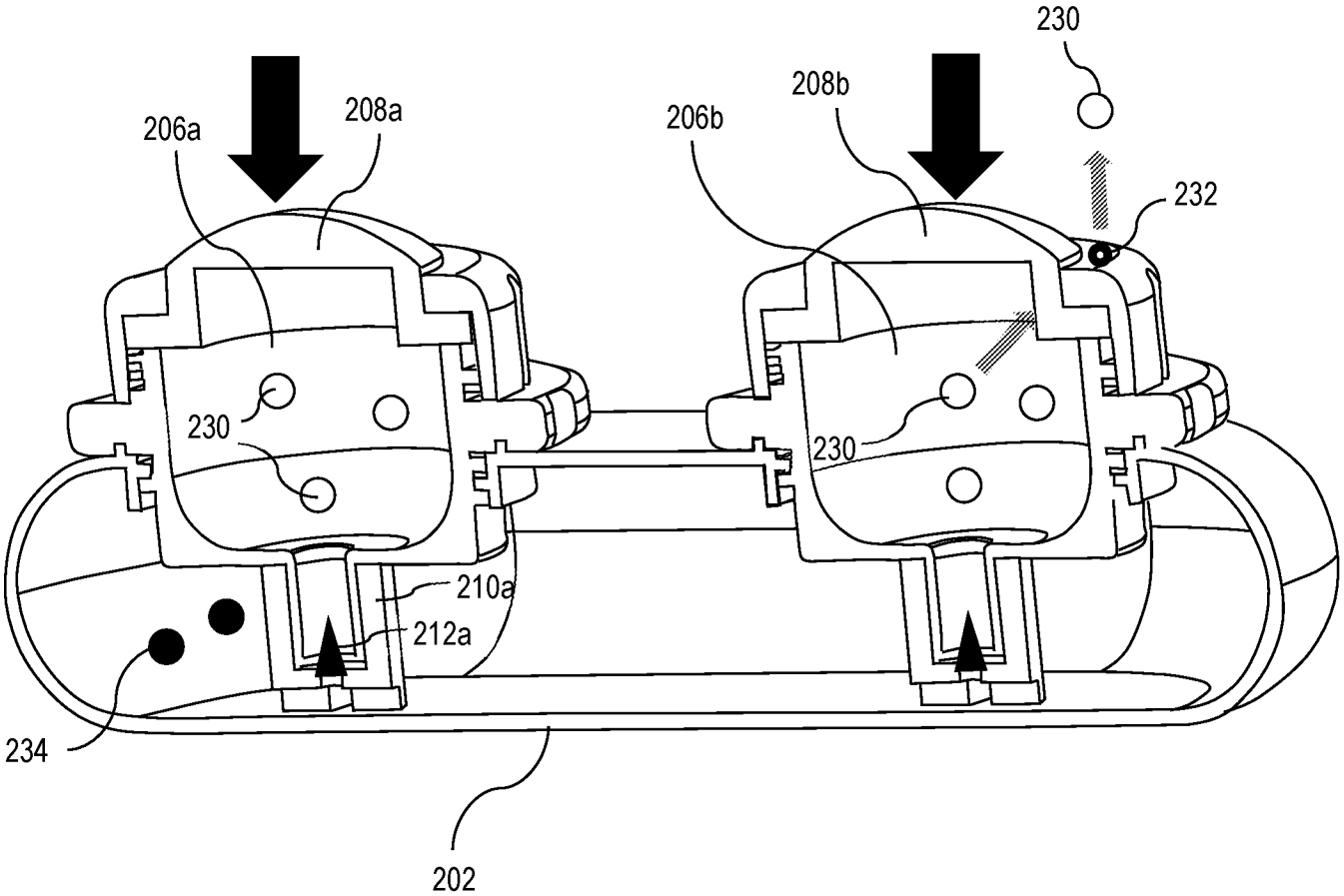
FIG. 2A is an illustration of fluid flow within particular embodiments of a contact lens case according to various aspects of the present disclosure.
Figure 2B:
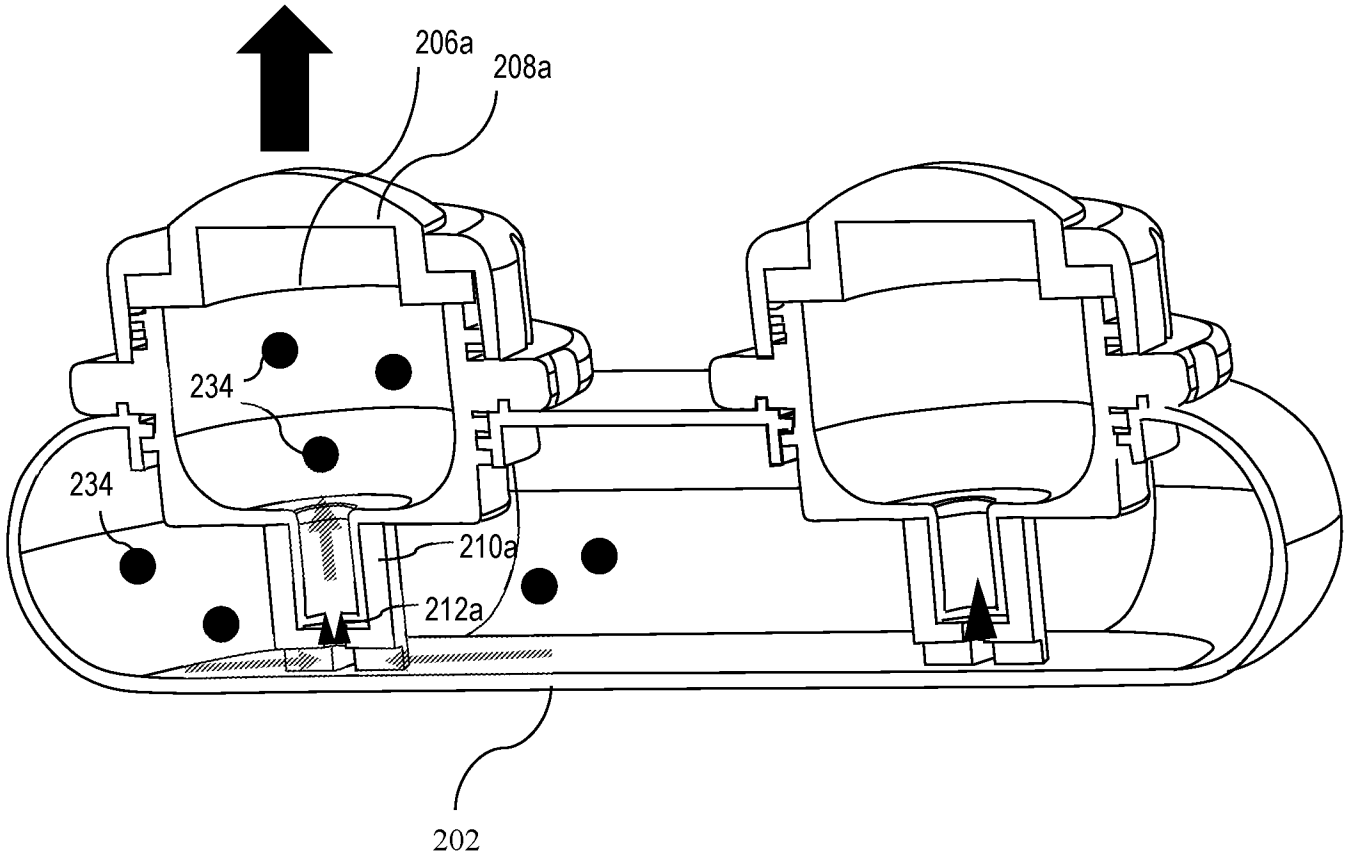
FIG. 2B is a further illustration of fluid flow within particular embodiments of the contact lens case of FIG. 2A according to various aspects of the present disclosure.

Now referring to FIGS. 2A and 2B generally, when a pressure pump (e.g., 208*a* or 208*b*) is actuated (as indicated by the large black downward arrow(s)), air 230 from within a corresponding lens reservoir (e.g., 206*a* or 206*b*) is forced out the corresponding lens reservoir by positive pressure. As one example, when the second pressure pump 208*b* is actuated, air 230 is expelled from an inside volume of the second lens reservoir 206*b* via an outlet 232 as described in greater detail herein. While only one outlet 232 is shown in FIG. 2A, in numerous embodiments the contact lens case 200 implement a second outlet disposed on the first pressure pump 208*a*.

Further, in various implementations, when a pressure pump (such as 208*a*) is released (as indicated by the solid arrow in FIG. 2B), fluid 234 from the fluid tank 202 is drawn into first lens reservoir 206*a* through the first suction line 210*a* and corresponding one-way valve 212*a* (e.g., duck bill valve as shown, but could alternatively be any other type of valve, such as a ball valve, etc.) by negative pressure caused by the release of the pressure pump 208*a*.

Figure 2C:
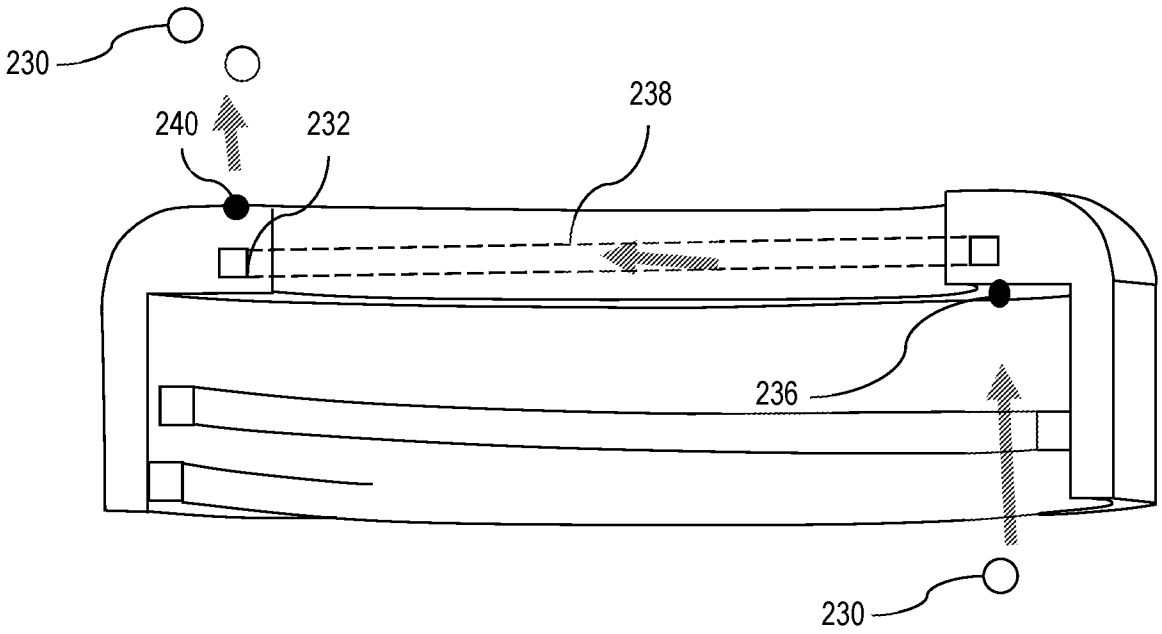
FIG. 2C is an illustration of a portion of a pressure pump that includes pump channel according to various aspects of the present disclosure.

FIG. 2C illustrates a close-up view of the outlet 232 on a portion of a pressure pump (e.g., 208*b*). Here, when the pressure pump is actuated (e.g., depressed), air 230 is forced through an inlet 236 that ultimately leads to the outlet 232. In multiple embodiments, a pump channel 238 is utilized to direct the air 230 from the inlet 236 to the outlet 232. In further embodiments, an outlet valve 240 (e.g., a one-way valve) or similar mechanism may be used to prevent air 230 from re-entering the outlet 232 (and ultimately to the lens reservoir through the pump channel 238). In this regard, one or more outlet valves 240, etc. may be used (e.g., one on the first lens assembly, one on the second lens assembly, etc.). In yet further embodiments, a filter (not shown) can be placed within the pump channel 238 and/or proximally to the outlet 240 to prevent contamination from foreign environments.

Configurations of the outlet 232, inlet 236, and the pump channel 238 as shown in FIG. 2C are by way of example only and by no means are limiting. For example, the inlet 236 may be disposed in a portion of a lens reservoir, while the outlet 232 is disposed on the pressure pump with the pump channel 238 connected therebetween.

Figure 2D:
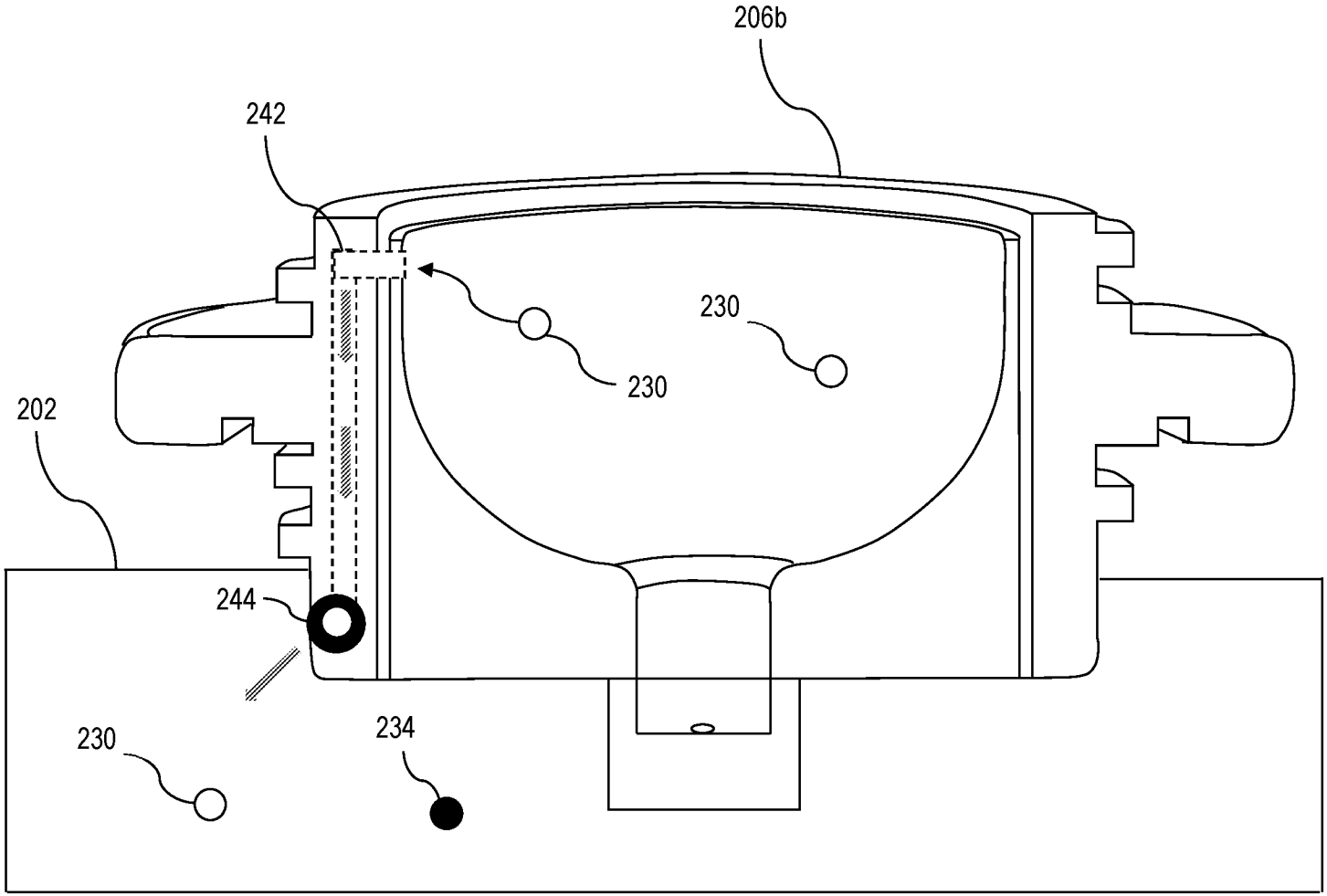
FIG. 2D is an illustration of a lens reservoir that includes reservoir channel according to various aspects of the present disclosure.

Now referring to FIG. 2D, further embodiments of the contact lens case 200 may utilize a reservoir channel 242 that leads (or extends) from a lens reservoir to the fluid tank 202. In this example, the reservoir channel 242 is disposed near the second lens reservoir 206*b*. While only one reservoir channel 242 is shown, in practice multiple reservoir channels may be used in one or more lens reservoirs.

Further, a flow mechanism 244 may be used to supplement the reservoir channel 242. The flow mechanism 244 (e.g., an O-ring of appropriate diameter) prevents fluid 236 from the tank 202 from entering the lens reservoir 206*b* via the reservoir channel 242 but allows air 230 to enter the fluid tank 202 from the lens reservoir 206*b* (i.e., acts as a one-way valve). Spatially, the flow mechanism 244 can be provided below a point where the lens reservoir 206*b* attaches to the fluid tank 202. This allows air 230 to pass between the fluid tank 202 and the lens reservoir 206*b*.

Fluid Tank

Figure 3:
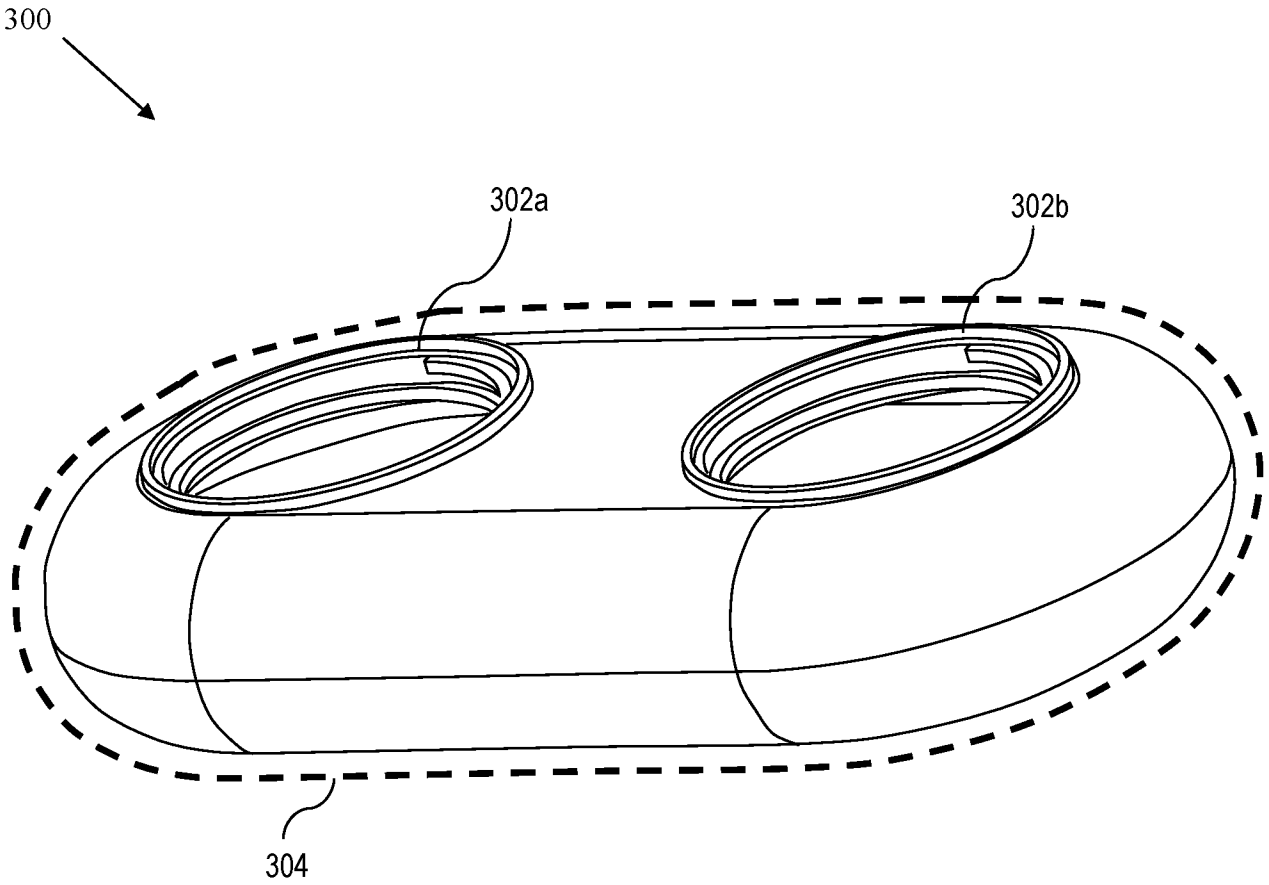
FIG. 3 is an example embodiment of a fluid tank according to various aspects of the present disclosure.

Referring to FIG. 3, an example fluid tank 300 is disclosed. All descriptions, explanations, and embodiments with respect to the example fluid tank 300 may apply to fluid tanks described elsewhere herein (e.g., FIGS. 1A, 1C, 2A, etc.). However, not all descriptions, explanations, and embodiments need apply.

In various embodiments, the fluid tank 300 comprises two sets of tank threads 302*a* and 302*b* that couple to the first lens reservoir and the second lens reservoir respectively (see reference number 106*a* and 106*b* of FIG. 1C). While only threads are shown in FIG. 300, other fastening methods may be used such as ball and socket, snap and button, snap-fit, etc.

Further, the fluid tank 300 may further comprise an external casing 304 that encloses at least a portion of the fluid tank 300. The external casing 304 can further enhance the durability of the fluid tank 300 (e.g., configured to absorb shock, impact, pressure change, etc.), as well as provide a shell that is customizable in terms of appearance. For example, a user may get a casing 304 with a sports team logo. The casing may also include a handle or a coupler for attachment to a suitcase or backpack for convenience. In certain other embodiments, the external casing 304 can be removable from the fluid tank 102 to provide further capability to the contact lens case.

In some embodiments, the external casing 304 can include additional features to aid in the convenience of usage. For instance, the external casing 304 (or any other component of the contact lens case) can include a clip (not shown) or a place to add a clip (not shown) that could attach to another structure (e.g., a book bag or travel suitcase). Moreover, other utility features, such as a mirror (not shown) can be provided (e.g., on an external surface, or within a hinged component). As yet another example, a pocket or pill case, etc., can be provided (e.g., store enzymatic cleaner tablets, or other contact lens accessory). Other features and advantages of the external casing 304 are disclosed herein.

Pressure Pump

Referring to FIG. 4A, an example embodiment of a pressure pump 400 is disclosed. All descriptions, explanations, and embodiments with respect to the example pressure pump 400 may apply to the first pressure pump and second pressure pump (see e.g., reference numbers 108*a* and 108*b* respectively of FIG. 1C) disclosed elsewhere herein. However, not all descriptions, explanations, and embodiments need apply.

In various embodiments, the pressure pump 400 is comprised of a button 402 and a cap 404 having cap threads 406 on an interior surface of the cap 404 as shown by semi-transparent lines. In many embodiments, a portion of the button 402 is recessed underneath a portion of the cap 404 (see pressure pump 108*b* in FIG. 2A).

The cap threads 406 thread into corresponding cap receiving threads on a lens reservoir (e.g., 106*a* of FIG. 2A and/or 106*b* of FIG. 2A). In certain embodiments, the button 402 can further comprise an atmospheric cap 408 to allows for the air to exit without the possibility of liquid to follow. In yet further embodiments, the button 402 and the cap 404 are a singular (i.e., unitized) piece or otherwise fixedly coupled or otherwise integral.

Yet further, in various embodiments the pressure pump 400 further comprises an outlet 410, which is analogous to the outlet described in FIG. 2C (see reference number 232).

Figure 4:
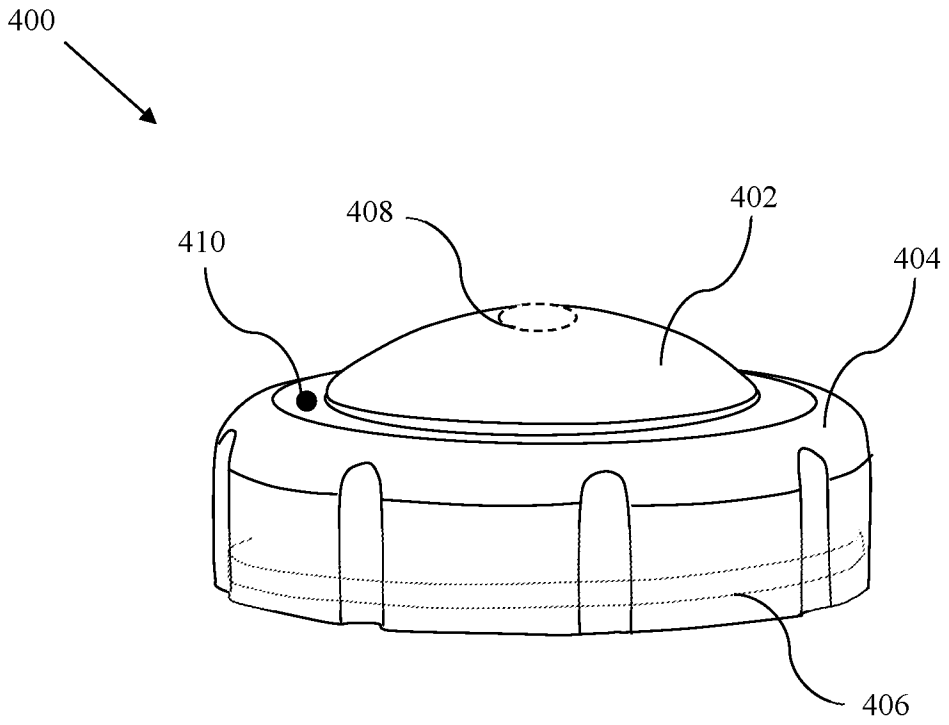
FIG. 4 is an example embodiment of a pressure pump according to various aspects of the present disclosure.
Figure 5A:
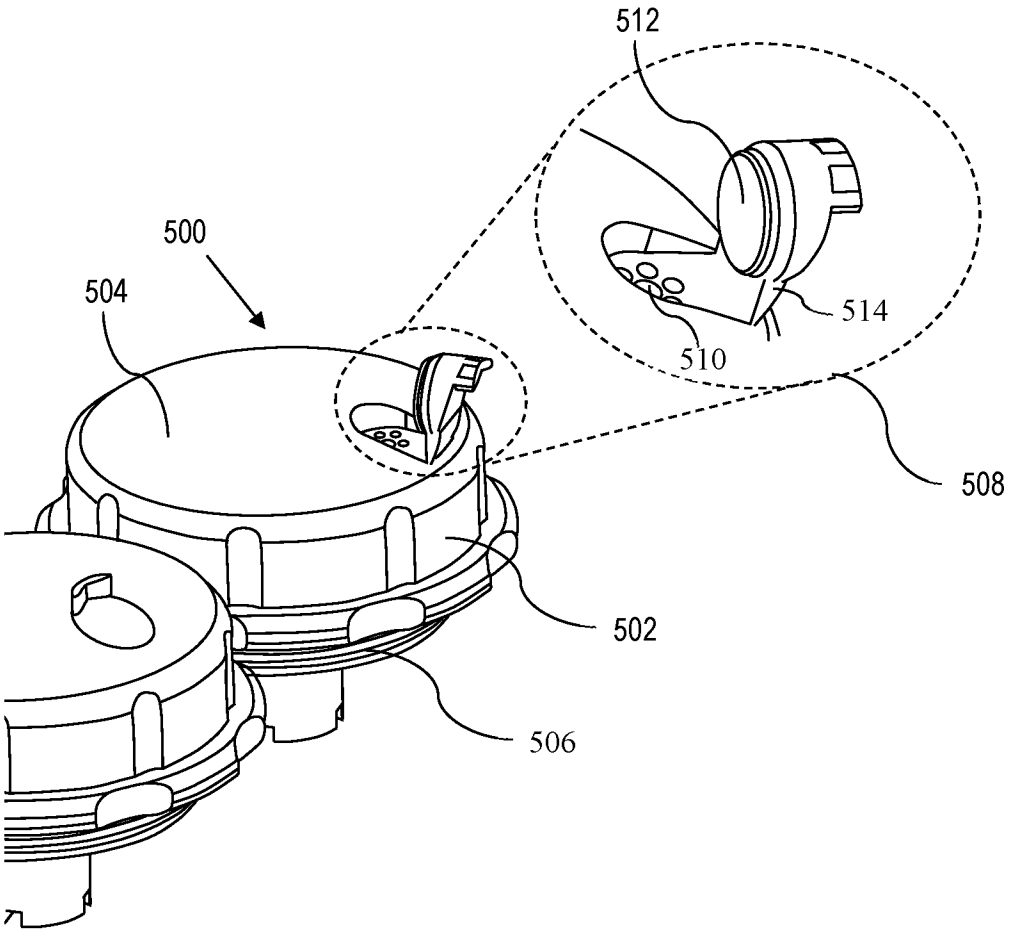
FIG. 5A is another example embodiment of a pressure pump according to various aspects of the present disclosure.

Referring now to FIG. 5A, an alternate embodiment of a pressure pump 500 is disclosed. Instead of a button and cap as illustrated in FIG. 4, the pressure pump 500 is comprised of a threaded member 502 and an over mold 504 that covers the threading member 502. The threaded member 502 provides an interface between the over mold 504 and various components of the contact lens case such as a lens reservoir 506 (analogous to lens reservoirs described herein).

Under such configurations, the over mold 504 functions like the various pressure pumps and buttons described herein. In various embodiments, the over mold 504 provides a complete seal over the lens reservoir 506. Thus, when the over mold 504 actuated (e.g., pressed downward toward the lens reservoir 506), positive pressure is created in the lens reservoir 506.

In multiple implementations, the over mold 504 further comprises an outlet assembly 508. In various embodiments, the outlet assembly 508 comprises an outlet port 510, a port plug 512, and a plug hinge 514. The outlet port 510 allows air (see air 230 in FIG. 2A) to escape the lens reservoir 506 when the over mold 504 is actuated. In FIG. 5A, the outlet port 510 shows seven holes, but virtually any numbers of holes (e.g., one hole, two, holes, three holes, etc.) may be used.

The port plug 512 allows a user to close or seal off the outlet port 510 when the pressure pump 500 is not in use. The port plug 512 can be selectively toggled between an open state and a closed state via the plug hinge 514 as shown in FIG. 5A. While the port plug 512 and the plug hinge 514 are called out separately, in practical applications they may comprise a single integral piece. Alternatively, the port plug 512 can be configured to be separate (or separable) from the over mold 504 (i.e., no plug hinge 514 to connect the port plug 512 to the over mold 504).

Figure 5B:
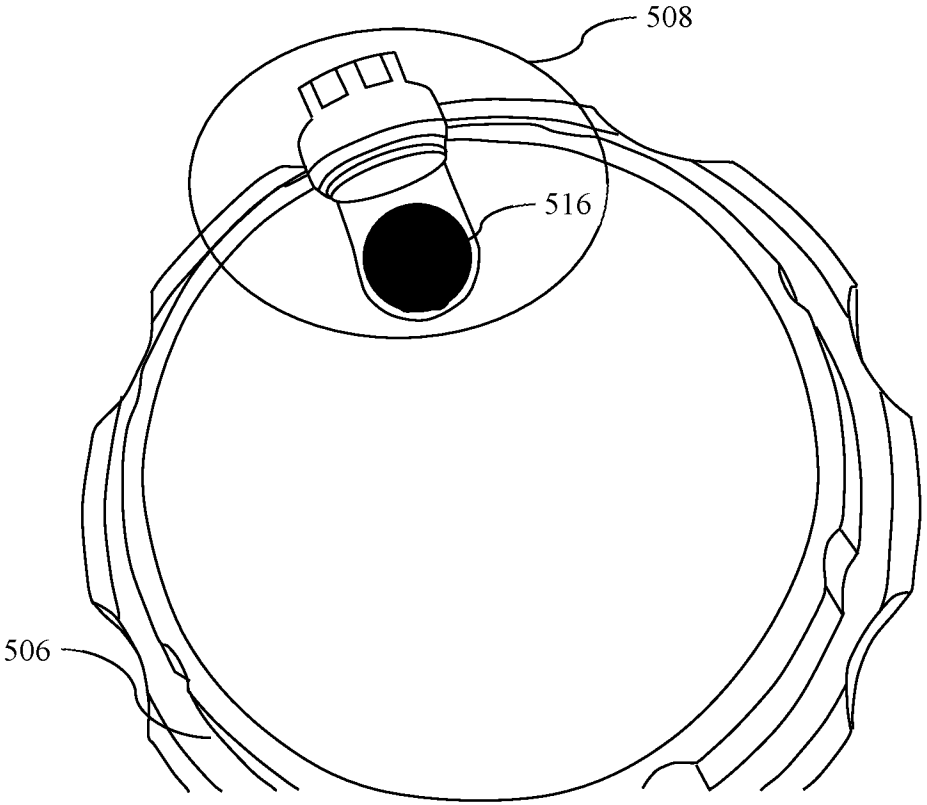
FIG. 5B is a top down view of the example embodiment of FIG. 5A according to various aspects of the present disclosure.

Briefly referring to FIG. 5B, the outlet assembly further comprises a one-way valve 516 that allows air to escape the lens reservoir 506 but prevents air from entering the lens reservoir 506 (e.g., when the over mold is released). In various embodiments, the one-way valve 516 is an umbrella valve. However, virtually any type of one-way valve (as discussed herein) is sufficient.

Suction Line

Figure 6:
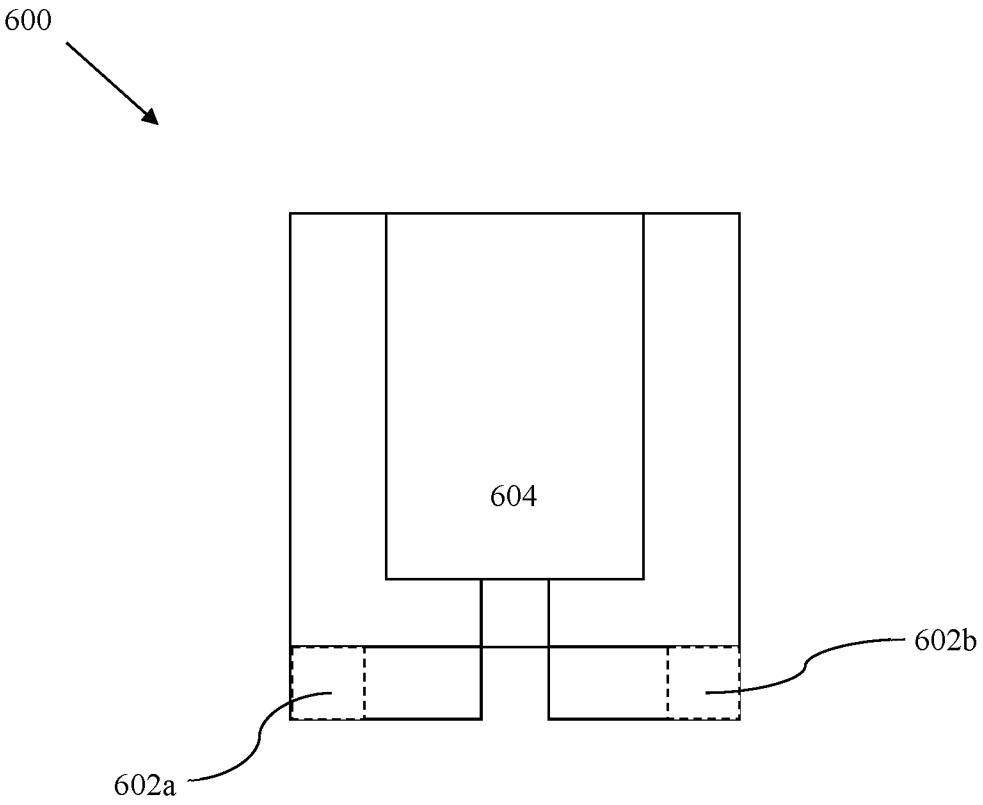
FIG. 6 is an example embodiment of a suction line according to various aspects of the present disclosure.

Referring to FIG. 6, an example embodiment of a suction line 600 is disclosed. All descriptions, explanations, and embodiments with respect to the example suction line 600 may apply to the first suction line and second suction line (ref numbers 110*a* and 110*b* respectively) disclosed elsewhere herein. However, not all descriptions, explanations, and embodiments need be applied.

In various embodiments, the suction line 600 comprises a first set of intake channels 602*a* and 602*b* that supply fluid, through a valve channel, to a lens reservoir. While FIG. 6 only illustrates two intake channels, the suction line 600 may have more or less intake channels. Further, the suction line 600 comprises an internal chamber 604 that accepts the lens reservoir, including the one-way valve.

One-Way Valve

Figure 7B:
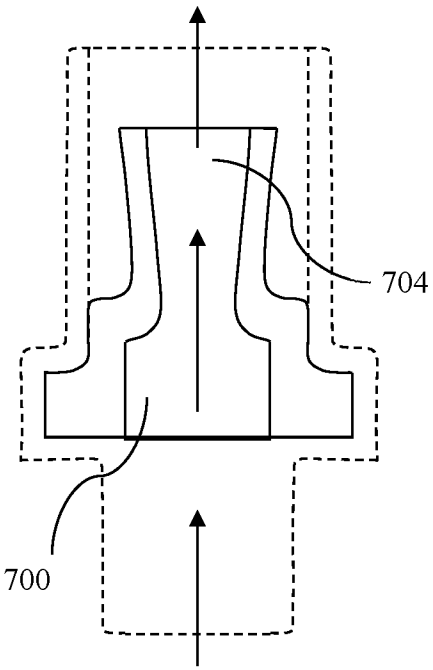
FIG. 7B is an example embodiment of the one-way valve of FIG. 6A showing fluid flow in a second direction, according to various aspects of the present disclosure.
Figure 7A:
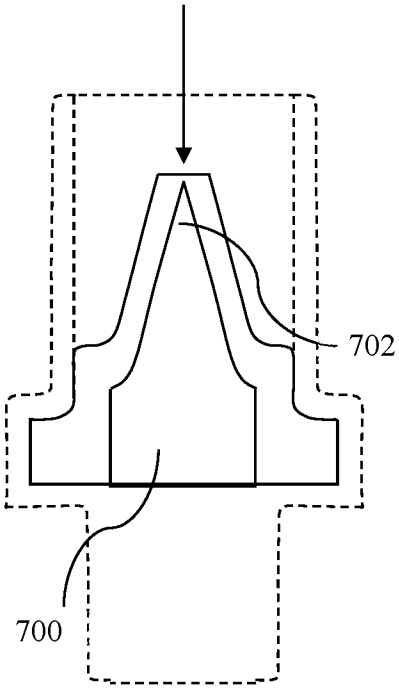
FIG. 7A is an example embodiment of a one-way valve showing fluid flow in a first direction according to various aspects of the present disclosure.
Figure 8:
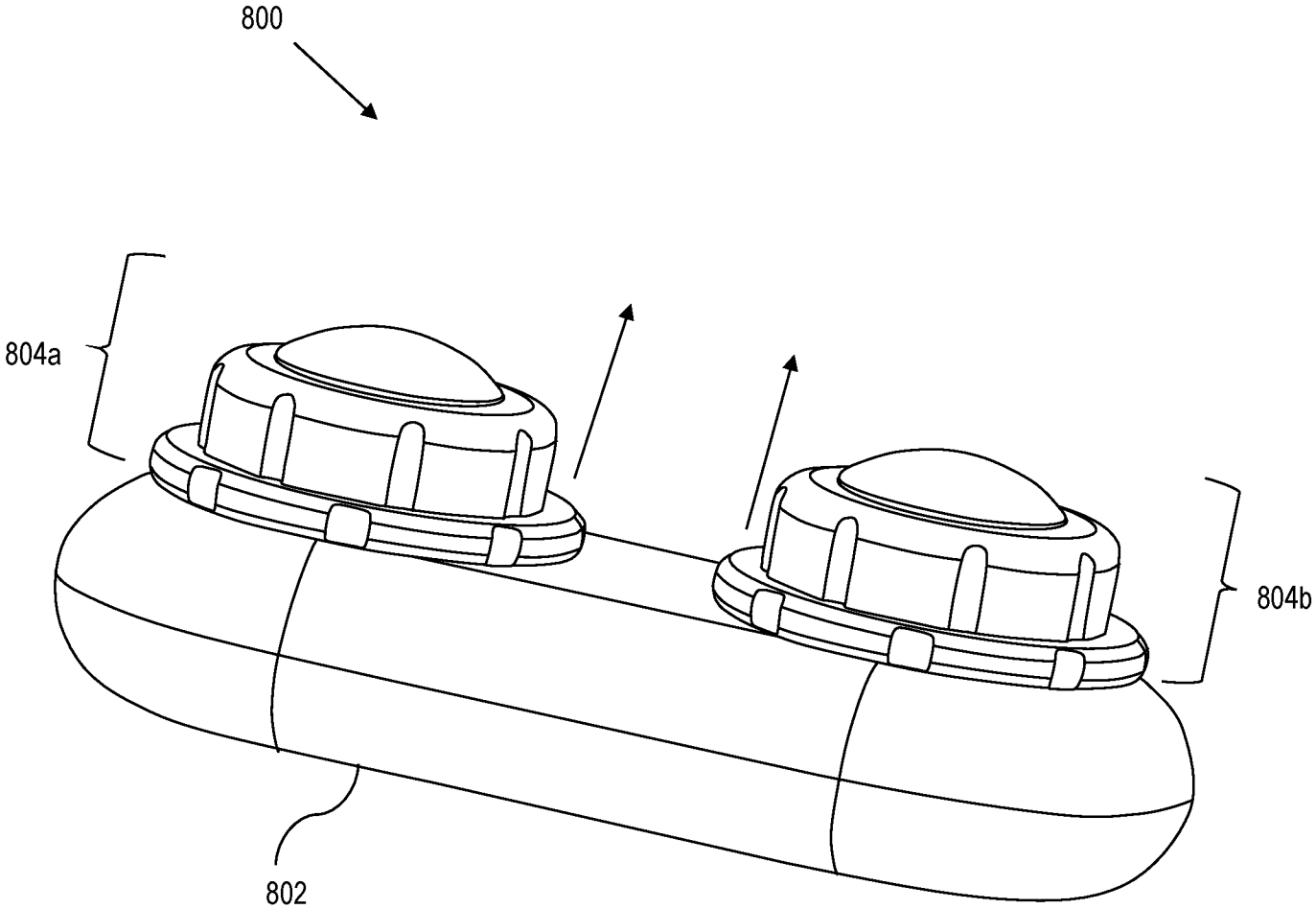
FIG. 8 is perspective view of an example embodiment of a contact lens case according to various aspects of the present disclosure.

Referring to FIGS. 7A and 7B, an example embodiment of a one-way valve 700 is disclosed. All descriptions, explanations, and embodiments with respect to the example one-way valve 700 may apply to the first one-way valve and second the second one-way valve (see reference numbers 112*a* and 112*b* respectively) disclosed herein. However, not all descriptions, explanations, and embodiments need be utilized. For clarity purposes, the one-way valve is in solid lines. Items in dashed lines are other components for various embodiments of the contact lens case.

In FIG. 7A, a duck bill valve is used as the one-way valve 700 (herein, "duck bill valve") for the lens assembly (e.g., see reference number 104*a* in FIG. 1C). In FIG. 7A, the duck bill valve 700 is in a closed configuration 702. While the duck bill valve 700 is in the closed configuration 702, fluid or air can not pass through the duck bill valve 702 as shown by the black arrow. In many embodiments, the closed configuration 702 is indicative of the pressure pump not being used.

However, when the duck bill valve 702 is in an open configuration 704, as shown in FIG. 7B, fluid or air may pass through the duck bill valve 702 as shown by the black arrows. In many embodiments, the open configuration 704 is indicative of the pressure pump being used.

While FIGS. 7A and 7B show a duck bill valve 702 as a representative one-way valve, other one-way valves and similar mechanisms may be used such as ball valves, diaphragm valves, tilting disc valves, flapper valves, stop-check valves, lift-check valves, in-line valves, pneumatic valves, umbrella valves, aspin valves, safety valve or relief valves, Schrader valve, solenoid valves, stopcock, swirl valves, tesla valve, thermal expansion valves, thermostatic mixing valve, thermostatic radiator valves, trap primer, and vacuum breaker valves. These examples are by way of example and by no means limiting.

Modular Contact Lens Case

According to aspects of the present disclosure, an embodiment of a modular contact lens case 800 is disclosed. All descriptions, explanations, and embodiments with respect to any other figures and/or disclosure can be applied to the modular contact lens case 800 herein. However, not all descriptions, explanations, and embodiments need be utilized.

The modular contact lens case 800 is analogous to the contact lens case 100 (lens reservoirs, pressure pumps, suction lines, valves, etc.) except that the lens assemblies 804*a* and 804*b* are explicitly user-removable from the fluid tank 802 as described herein. An advantage of the modular contact lens case 800 is that having the ability to remove the lens assemblies 804*a* and 804*b* from the fluid tank 802 allows a user to swap out components that break or malfunction.

Travel Components

Given how the various contact lens cases as disclosed herein are generally portable, aspects of the present disclosure also contemplate travel components that supplement multiple embodiments of the contact lens cases. For clarity, unless otherwise stated, the following travel components are applicable to all contact lens cases described herein.

Figure 9:
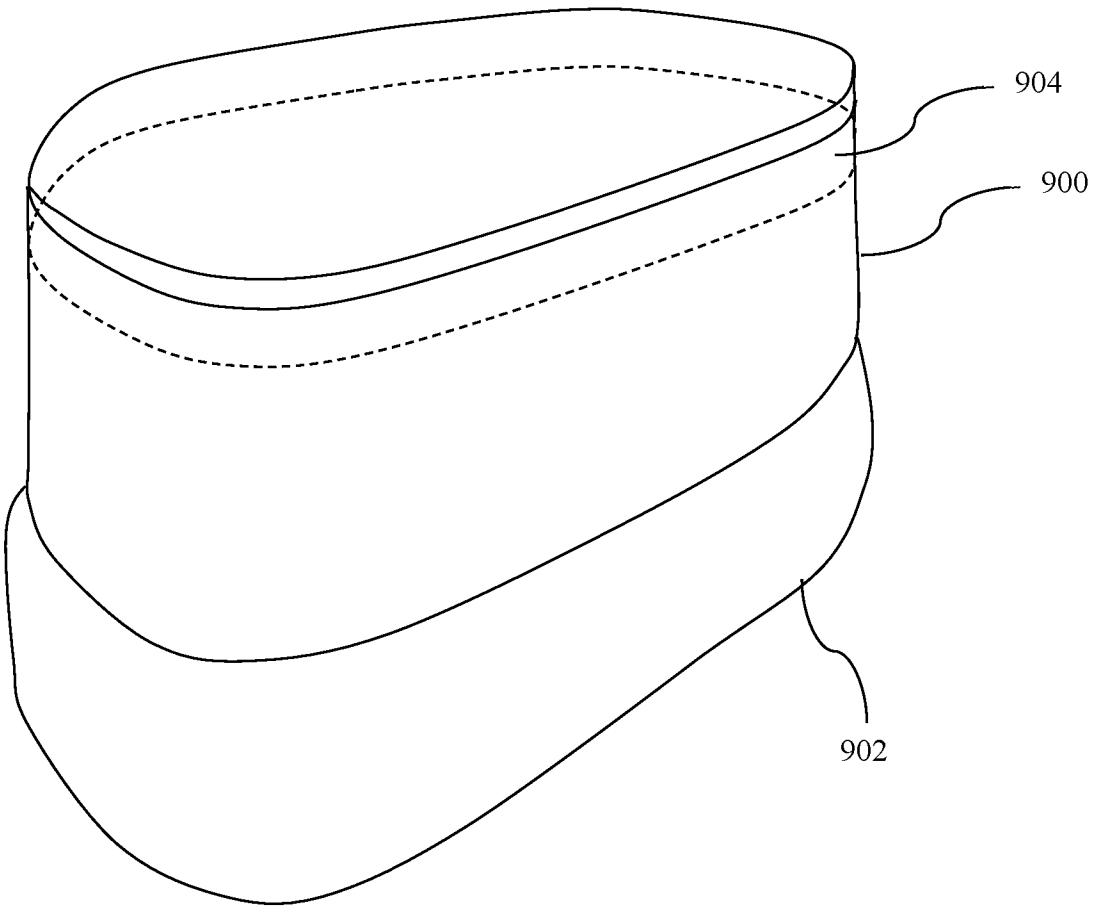
FIG. 9 is a perspective view of an external casing according to various aspects of the present disclosure.

Now referring to FIG. 9, an embodiment of an external casing 900 is disclosed. Here, the external casing 900 is covering a portion of a contact lens case, leaving a fluid tank 902 of the contact lens case partially exposed. In various embodiment, the external casing 900 complete enclose the contact lens case.

There are numerous ways that the external casing 900 can couple to the contact lens case. For example, the fluid tank 902 of the contact lens case may have a ridge that the external casing 900 "snaps" onto (e.g., snap-fit). In other implementations, the external casing 900 can snap-fit over portions of a lens assembly disposed on the fluid tank 902, such as the gripping members (G2 in FIG. 1D).

The external casing 900 provides numerous advantages. For example, the external casing 900 prevents (or mitigates) damage to components of the contact lens case (e.g., lens assemblies). The external casing 900 also prevents accidental actuation of various pressure pumps (see e.g., first pressure pump 106*a* and second pressure pump 206*b*).

Figure 10:
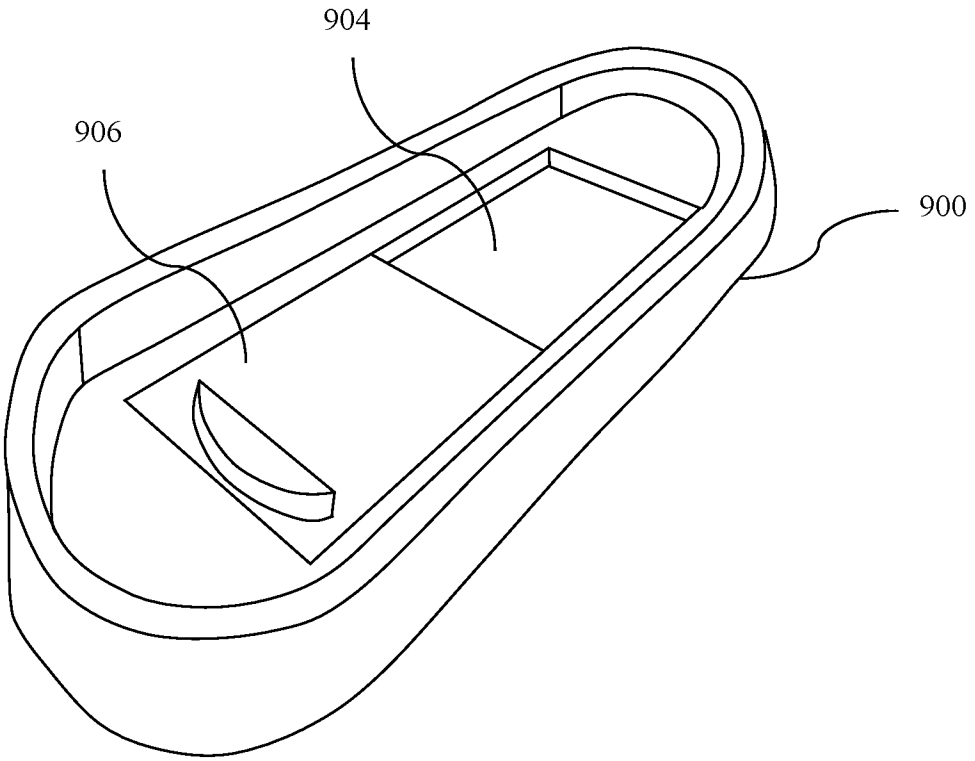
FIG. 10 is an underside of the external casing of FIG. 9 according to various aspects of the present disclosure.

In multiple embodiments, the external casing 900 further comprises a storage compartment 904 disposed on an inside portion of the external casing 900. FIG. 10 illustrates an example implementation of the external casing 900, where an enclosure mechanism 906 (e.g., a sliding door as shown in FIG. 10) opens and closes to allow accessibility into the storage compartment 904.

Various aspects of the present disclosure also provide for a keyring or keychain lanyard that allows a user to attach the contact lens case to a keyring, backpack, purse, etcetera. In multiple embodiments, the lanyard comprises a rubber skin that wraps around the fluid tank (see fluid tank 902 in FIG. 9) and a "string" piece that loops through itself (e.g., a ball that is pressed into a circular hole on the string piece) to close a loop for the lanyard.

Figure 11:
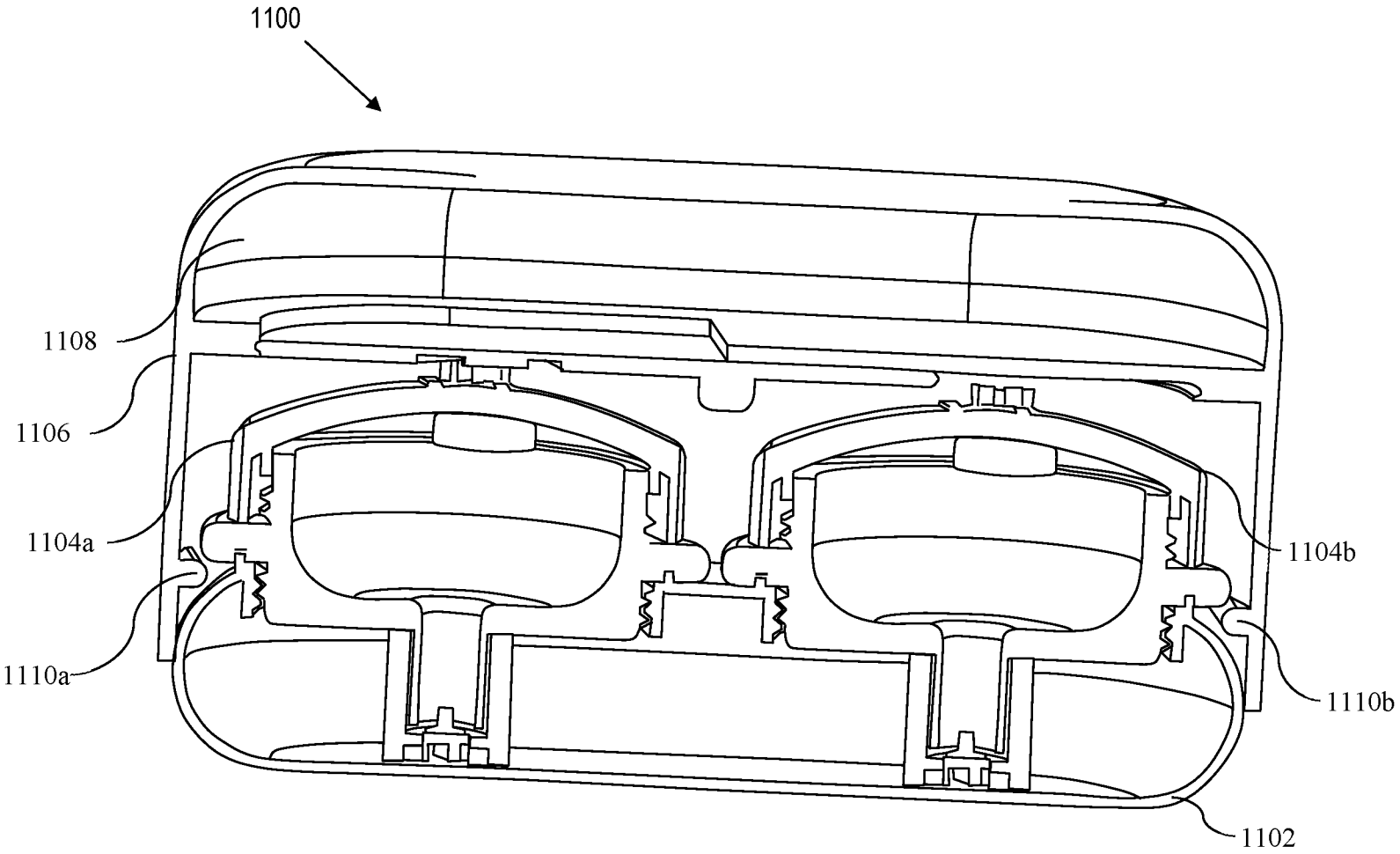
FIG. 11 is perspective view of an example embodiment of a contact lens case according to various aspects of the present disclosure.

Briefly referring to FIG. 11, an example contact lens case with external casing (hereinafter "the case") 1100 is disclosed. All descriptions, explanations, and embodiments with respect to any other figures and disclosure can be applied to the case 1100 herein. However, not all descriptions, explanations, and embodiments need be utilized.

Here, the case 1100 includes a fluid tank 1102, a first lens assembly 1104*a*, a second lens assembly 1104*b*, and an external casing 1106 with corresponding storage compartment 1108. In this example, the external casing 1106 engages the first lens assembly 1104*a* and the second lens assembly 1104*b* by using corresponding tab members 1110*a* and 1110*b*. In this example, the corresponding tab members 1110*a* and 1110*b* snap-fit over portions of the first lens assembly 1104*a* and the second lens assembly 1104*b* as shown in FIG. 11.

Alternatively, or in addition to the above, the external casing 1106 may similarly engage other components such as the fluid tank 1102 for increased gripping performance.

Moreover, in this example case 1100, pressure pumps analogous to those described in FIGS. 5A-5B (e.g., pressure pumps with outlet assembly) are utilized as opposed to pressure pumps that are analogous to those described in FIG. 4. However, the pressure pumps can be used interchangeably.

Miscellaneous

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the invention in the form disclosed. Many modifications and variations will be apparent to those of ordinary skill in the art without departing from the scope and spirit of the invention. Aspects of the disclosure were chosen and described in order to best explain the principles of the invention and the practical application, and to enable others of ordinary skill in the art to understand the invention for various embodiments with various modifications as are suited to the particular use contemplated.

What is claimed is:

1. A contact lens case comprising:
a fluid tank;
a first lens assembly coupled to the fluid tank, the first lens assembly comprising:
a first lens reservoir;
a first pressure pump disposed on a top surface of the lens reservoir;
a first suction line that draws fluid from the fluid tank to the first lens reservoir; and
a first one-way valve that allows fluid to transfer from the fluid tank, through the first suction line, and into the first lens reservoir of the first lens assembly upon actuation of the first pressure pump; and
a second lens assembly coupled to the fluid tank, the second lens assembly comprising:
a second lens reservoir;
a second pressure pump disposed on a top surface of the second lens reservoir;
a second suction line that channels fluid from the fluid tank to the second lens reservoir;
a second one-way valve that allows fluid to transfer from the fluid tank, through the second suction line, and into the second lens reservoir of the second lens assembly upon actuation of the second pressure pump.

2. The contact lens case of claim 1, wherein:
the first lens assembly is coupled to the fluid tank so as to be removable from, and re-attachable to the fluid tank; and
the second lens assembly is coupled to the fluid tank so as to be removable from, and re-attachable to the fluid tank.

3. The contact lens case of claim 1, wherein the first pressure pump comprises:
a threaded member; and
an over mold that covers the threading member, thereby sealing the lens reservoir.

4. The contact lens case of claim 3, wherein the threaded member and the over mold are a single component.

5. The contact lens case of claim 3 further comprising:
an outlet assembly comprising:
an outlet port disposed on the over mold that allows air to escape the lens reservoir when the over mold is actuated;
a port plug that, when actuated to a closed state, seals the outlet port; and
a plug hinge coupled to the port plug and the over mold, wherein the plug hinge toggles the port plug between an open state and the closed state.

6. The contact lens case of claim 3 further comprising:
an outlet assembly comprising:
an outlet port disposed on the over mold that allows air to escape the lens reservoir when the over mold is actuated;
a port plug that, when actuated to a closed state, seals the outlet port;
wherein:
the port plug is separable from the outlet assembly.

7. The contact lens case of claim 1, wherein:
the first lens reservoir further comprises a first valve channel that is adjacent to the first suction line, wherein the first valve channel further comprises a first inlet that accepts fluid from the fluid tank; and
the second lens reservoir comprises a second valve channel that is adjacent to the second suction line, wherein the second valve channel further comprises a second inlet that accepts fluid from the fluid tank.

8. The contact lens case of claim 7, wherein:
the first valve channel and the second valve channel each have a first diameter;
the first inlet and the second inlet each have a second diameter; and
the first diameter is greater than the second diameter.

9. The contact lens case of claim 1, wherein:
the first lens assembly further comprises a first outlet that expels air from an inside volume of the first lens reservoir when the first pressure pump is actuated; and
the second lens assembly further comprises a second outlet that expels air from an inside volume of the second lens reservoir when the first pressure pump is actuated.

10. The contact lens case of claim 9, wherein:
the first outlet further comprises a first outlet valve that prevents air from re-entering the first outlet; and the second outlet further comprises a second outlet valve that prevents air from re-entering the second outlet.

11. The contact lens case of claim 1, wherein:

the first suction line comprises a first set of intake channels that supply fluid through a first valve channel to the first lens reservoir; and the second suction line comprises a second set of intake channels that supply fluid through a second valve channel to the second lens reservoir.

12. The contact lens case of claim 1, wherein:

the first pressure pump and the second pressure pump are independent of one another for purposes of fluid extraction from the fluid tank.

13. The contact lens case of claim 1, wherein:

the first suction line extends from the first lens reservoir to a bottom surface of the fluid tank; and the second suction line extends from the second lens reservoir to a bottom surface of the fluid tank.

14. A modular contact lens case comprising:

a fluid tank;

a first lens assembly removably couplable to the fluid tank, the first lens assembly comprising:

a first lens reservoir;

a first pressure pump disposed on a top surface of the lens reservoir;

a first suction line that draws fluid from the fluid tank to the first lens reservoir; and a first one-way valve that allows fluid to transfer from the fluid tank, through the first suction line, and into the first lens reservoir of the first lens assembly upon actuation of the first pressure pump; and a second lens assembly removably couplable to the fluid tank, the second lens assembly comprising:

a second lens reservoir;

a second pressure pump disposed on a top surface of the second lens reservoir;

a second suction line that channels fluid from the fluid tank to the second lens reservoir;

a second one-way valve that allows fluid to transfer from the fluid tank, through the second suction line, and into the second lens reservoir of the second lens assembly upon actuation of the second pressure pump.

15. The contact lens case of claim 14 further comprising a removable external casing that encloses at least a portion of the contact lens case, wherein the removable external casing comprises a storage compartment disposed on an inside portion of the removable external casing.

* * * * *